United States Patent [19]

Gorissen

[11] Patent Number: 4,663,862

[45] Date of Patent: May 12, 1987

[54] WEB TENSION CONTROL DEVICE PROVIDED AT A VERTICAL DRIER FOR CLOTH WEB

[75] Inventor: Erich Gorissen, Leichlingen, Fed. Rep. of Germany

[73] Assignee: Vits Maschinenbau GmbH, Langenfeld, Fed. Rep. of Germany

[21] Appl. No.: 798,776

[22] Filed: Nov. 18, 1985

[30] Foreign Application Priority Data

Nov. 28, 1984 [DE] Fed. Rep. of Germany ..... 3443357

[51] Int. Cl.[4] ..... F26B 13/12

[52] U.S. Cl. ..... 34/52; 34/120; 226/44

[58] Field of Search ..... 226/44, 30; 34/117, 34/120, 155, 52, 43, 56

[56] References Cited

U.S. PATENT DOCUMENTS 3,326,436 6/1967 Huck ..... 226/30

4,033,492 7/1977 Imai ..... 226/44

*Primary Examiner*—Larry I. Schwartz

*Attorney, Agent, or Firm*—Sprung Horn Kramer & Woods

[57] ABSTRACT

The present invention relates to a web tension control device provided at a vertical drier for cloth webs, in which the cloth web is guided by means of conveyor means located in front of the lower cloth web inlet and after the lower cloth web outlet and by means of guide rollers provided in driven motion in the upper area of the drier. In order to detect without error the tension of the upward running cloth web, guide rollers 16, 17 are provided together with their common drive 18 on a rocker member 30 located outside the drier. The rocker member axis 30 is located immediately adjacent to the second guide roller 17 in running direction, while rocker member 30 is supported at the other end on a pressure cell 34 emitting a signal for the tension of the upward running cloth web.

10 Claims, 5 Drawing Figures

WEB TENSION CONTROL DEVICE PROVIDED AT A VERTICAL DRIER FOR CLOTH WEB

BACKGROUND OF THE INVENTION

1. Field of the Invention

The present invention relates to a web tension control device provided at a vertical drier for cloth web, comprising in front of the lower cloth web inlet driven conveyor means, and the upper area of which comprises in particular driven guide rollers, and after the lower cloth web outlet of which are provided further driven cloth web conveyor means serving in particular as guide motor, wherein the drives of at least one of the conveyor means and, if necessary of the guide rollers are speed-controlled depending on the longitudinal web tension detected by sensing elements in the upward and downward guided cloth web.

2. Discussion of Prior Art

In vertical driers for cloth webs it is usual to guide the cloth web under tension between blast nozzles bilaterally loading them with drying air. The longitudinal tension in the upward and downward guided webs depends on one hand on the dead weight of the cloth web and on the other hand on the differential speed of the conveyor or guide means located at the beginning and at the end of each cloth web. In order to avoid overloading of the cloth web it is necessary to correlate the drive motors with a web tension control device.

The detection of the longitudinal tension in the cloth web running from the upper guide roller downward to the conveyor means located after the cloth web outlet of the drier is without problem. By means of a free-wheeling guide roller located in the web running direction in front of the conveyor means and supported at a pressure cell, it is possible to detect precisely the web tension without the portion resulting from the dead weight of the cloth web. Since in the downward guided cloth web the drying processes is almost stopped and since as a consequence the portion of the web tension resulting from the dead weight is practically unchanged, it may be considered as a constant value. Contrary to this, the detection of the web tension in the upward running cloth web is problematic. For different reasons a detection of the traction force by means of the bearing pressure of the first guide roller located in the cloth web running directions, would lead to errors: since in certain production adjustments the cloth web at the upper guide roller is not yet completely dried and therefore adheres to its envelope, the bearing pressure will be reduced due to the traction force produced by tne following driven guide roller. A driving motion of the guide rollers is always necessary when cooling rollers are used to which a cooling agent is fed through terminal heads. In fact, terminal heads impair easy rotatability of the rollers so that said rollers can no more be dragged along by the cloth web and have to be provided with a drive. Finally, the location of the bearing pressure measurement on the rollers inside the drier is problematic since the sensing elements are rapidly contaminated by the drier environment and become ineffective.

A tension detection directly in front of the lower drier inlet would therefore be ideal since at this point the described difficulties do not occur, and the portion of tension resulting in front of the upper guide roller from the cloth web weight varying with the drying degree of the web, is not integrated into the tension measurement. But there exist other problems for the tension detection in front of the lower cloth web inlet. In fact, it is barely possible to connect a measuring device for tension detection to a wet cloth web. For this reason, drive motors have never been adjusted to date depending on the tension in the upward running cloth web. Instead of this, the drive motors have been adjusted according to experimental values and by eye sight and with sufficient slack in order to avoid overloading. This resulted nevertheless in the drawback of a less precise guiding of the cloth web. Furthermore, it is known for cloth web winding processes to combine a speed control of the cloth web with a web tension control device (DE-AS No. 10 84 568). In this prior device the web tension is determined by the weight of a compensating roller and a variable load. The variable load is formed by a liquid contained in a reservoir conceived as a rocker member, the movement of which is coupled to that of the compensating roller. The position of the compensating roller determines on the one hand the winding speed and on the other hand the web tension. At constant rotational speed of the winding reel the winding speed is increased due to the growing winding diameter. By this action the compensating roller is lifted. This causes a displacement of the liquid contained in the reservoir and thus a relief of the web tension, but also a reduction of the cloth web speed. Thus is ensured that with increasing winding diameter the web tension as well as the winding tension is reduced. This means that in this prior device the web tension is not measured subsequently to varying the winding speed, but there occurs as a direct reaction to an increased cloth web speed an uncontrolled tension relief.

SUMMARY OF THE INVENTION

The present invention is based on the object to create a web tension control device provided at a vertical drier for cloth web permitting to control also the tension in the upward running cloth web. In a web tension control device of the above described type this object is solved by the fact that the guide rollers are supported on a rocker member the axis of which is located adjacent the guide roller for the downward running cloth web, and that the sensing element for the detection of the longitudinal tension of the upward guided cloth web is responsive to the motion of the rocker member.

In this inventive solution both cloth webs are tensionally decoupled so that it is possible to precisely detect both web tensions. Through the arrangement of both guide rollers on a rocker member the measuring error caused by the bearing pressure measurement at the first guide roller in web running direction due to the adherant force of the cloth web is eliminated. The sensing element provided at the rocker member now senses the total web tension resulting from the cloth web weight of the upward running web and from the differential speed of the drive means located in front of the cloth web inlet and of the guide roller.

Tensional decoupling between both cloth webs is optimal when the rocker member axis is aligned with the downward running cloth web and in particular when the rocker member axis is aligned with the envelope of the guide roller.

According to one inventive embodiment the shaft ends of the pair of guide rollers extend through the lateral walls of the drier housing to the outside, supported on the rocker member conceived as frame and enclosing the drier housing. Through this embodiment all parts which could be contaminated and have to be serviced, are protected against the influence of the drier environment. This applies in particular to the sensitive sensing elements.

As far as the guide rollers are to be driven their drive motor should be supported by the rocker member in order to avoid that the drive member causes errors in the tension direction. In general, such a motor drive will be provided in such cases in which the guide rollers are conceived as cooling rollers the shaft ends of which extending from the drier housing with terminal heads for the feed and discharge line of the cooling agent. In such an embodiment the strain on the cloth web would be too high if said cloth web were to drag the cooling rollers.

There exist several possibilities for the concept of the sensing element detecting the web tension.

According to a first alternative the rocker member is supported by a pressure gauge serving as sensing element, while according to a second alternative the rocker member is suspended at a tensiometer serving as sensing element.

There also exist several possible concepts for the rocker member. According to a first embodiment the rocker member consists of an integral frame formed by longerons and crossbeams, while according to a second embodiment said rocker member consists of two independent longerons, each correlated to a sensing element. In the second embodiment the values measured by both sensing elements are electrically combined into a signal representing the total tension.

DESCRIPTION OF AN EMBODIMENT OF THE INVENTION

DETAILED DESCRIPTION OF THE EMBODIMENT OF THE INVENTION

Figure 1:
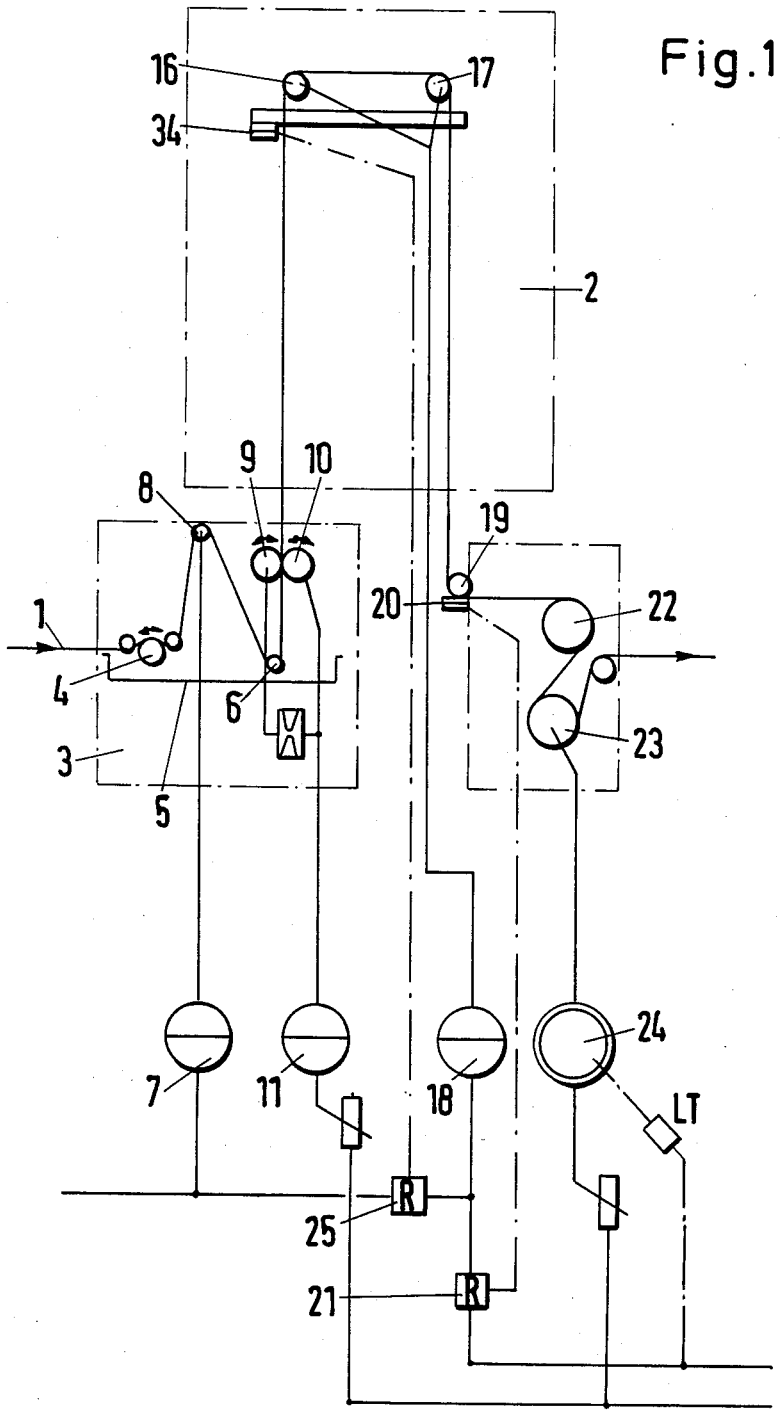
FIG. 1 a schematic view of a vertical drier with an impregnating installation located in front of said drier and cooling rollers located after said drier as well as their drive scheme.

A cloth web 1, consisting for instance of fiber glass having a weight of less than 50 g/m$^2$ passes through an impregnating installation 3 before reaching drier 2.

In impregnating installation 3, an application roller 4 dipping into an impregnation agent contained in a tank 5, unilaterally applies the impregnation agent onto cloth web 1. By means of dipping roller 6 cloth web 1 is dipped into the impregnation agent. Between rollers 4 and 6 is provided conveyor roller 8 coupled to a drive motor 7. At the outlet of impregnation installation 3 cloth web 1 is conveyed between a pair of squeezing cylinders 9,10 driven by a common drive 11. The impregnated cloth web passes vertically guided through a lower cloth web inlet into drier 2. In the upper area it is guided by a pair of guide rollers 16, 17 driven by a common drive 18. Vertically guided cloth web 1 leaves drier 2 through a lower cloth web outlet and is conveyed by a freewheeling guide roller 19 to a pair of cooling rollers 22, 23 driven by a drive 24. Together with their drive 24 cooling rollers 22, 23 represent the leading drive for the complete impregnating and drying installation.

The bearing pressure of guide roller 19 is detected by a pressure cell 20 and fed as an actual value to a control device 21.This permits it to detect the tension in the downward running cloth web between guide roller 17 and the driven cooling rollers 22, 23. From a further later described sensing element for web tension provided in the upward running web between squeezing cylinders 9,10 and guide roller 16 control device 25 receives an actual value signal. Depending on this actual value signal the control device controls drive 7. As far as drive 24 is used as leading a drive it is only necessary to control drives 7, 18 in order to obtain the desired web tension in the upward and downward running cloth web.

Figure 2:
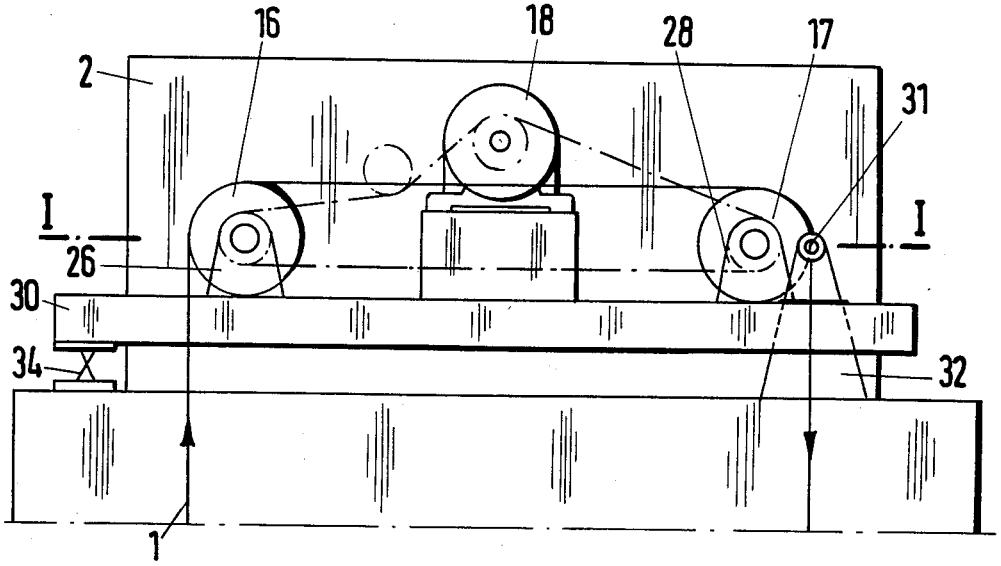
FIG. 2 a side elevation of the pair of guide rollers in the upper area of the drier.
Figure 3:
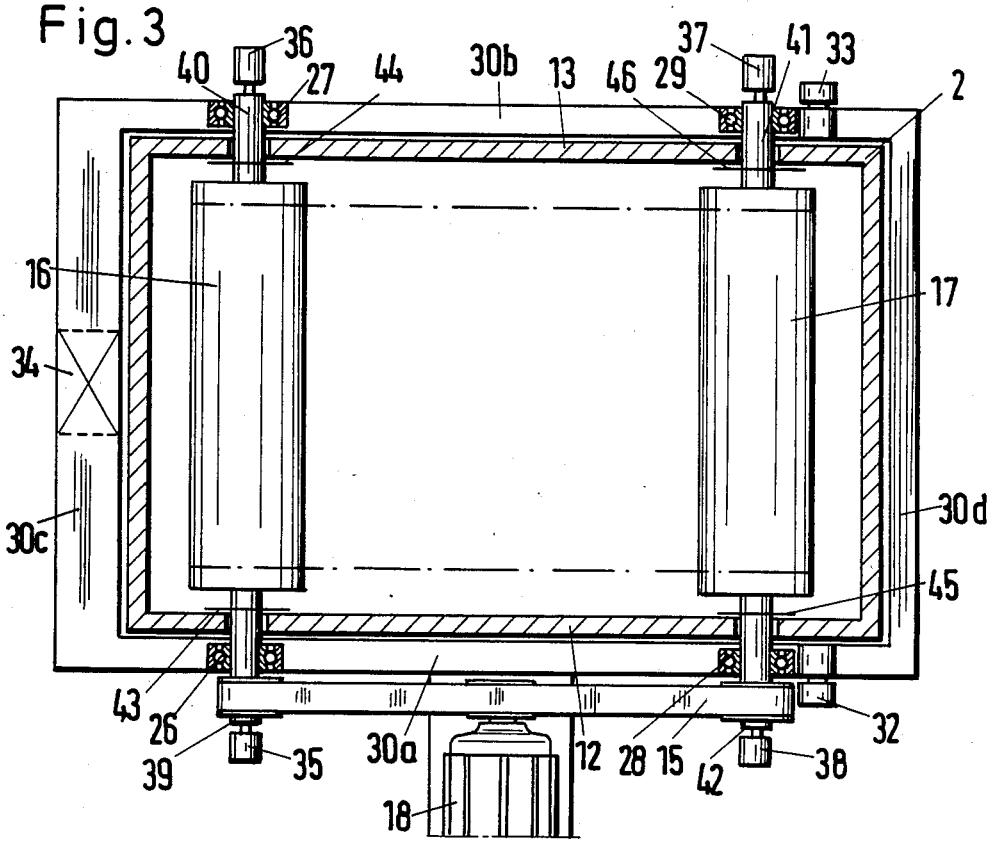
FIG. 3 a sectional view of the pair of guide rollers of FIG. 2 along line I—I of FIG. 2.

As shown in FIGS. 2 and 3, guide rollers 16, 17 extend with their shaft ends 39 to 42 through apertures in lateral walls 12, 13 of the drier housing to the outside. Said apertures are sealed by means of sealing discs 43 to 46. Guide rollers 16, 17 are supported by means of bearing blocks 26 to 29 on rocker member 30 conceived as frame enclosing the drier housing, the rocker member axis 31 being located on the envelope of guide roller 17 in the starting point of the downward guided cloth web. Rocker member 30 is provided on bearing blocks 32, 33 located at drier housing 2. At the side opposite rocker axis 31 rocker member 30 is supported on a pressure cell 34 supplying to governor 25 the actual value signal for the tension in the upward running cloth web.

Drive motor 18, which is common for both rollers 16, 17, is also mounted on rocker member 30 and coupled through an endless tension means, e.g. a toothed pulley 15, with the pair of guide rollers 16, 17. As generally rollers 16, 17 are conceived as cooling rollers, they may be provided at their shaft ends 39 to 42 with terminal heads 35 to 38 for cooling agent feed and discharge lines.

This embodiment ensures that measuring errors due to drive motors or due to the adherence of the cloth web do not occur in the tension detection of the upward running cloth web. In addition to that, all parts sensitive against the drier environment, such as sensing elements, drives and bearings are protected against the drier environment.

Figure 4:
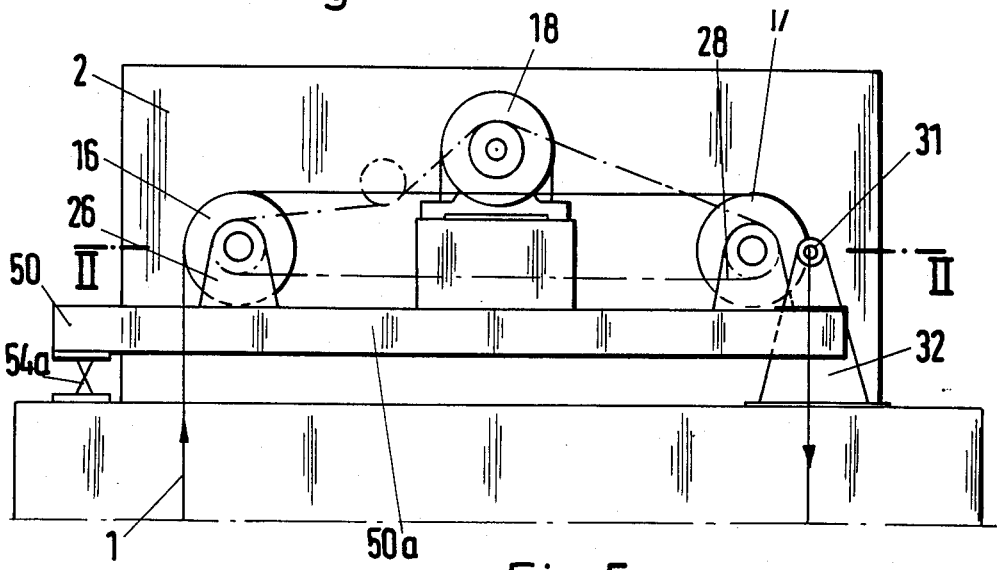
FIG. 4 a side elevation of the pair of guide rollers in the upper area of the drier in an embodiment differing from FIGS. 2 and 3.
Figure 5:
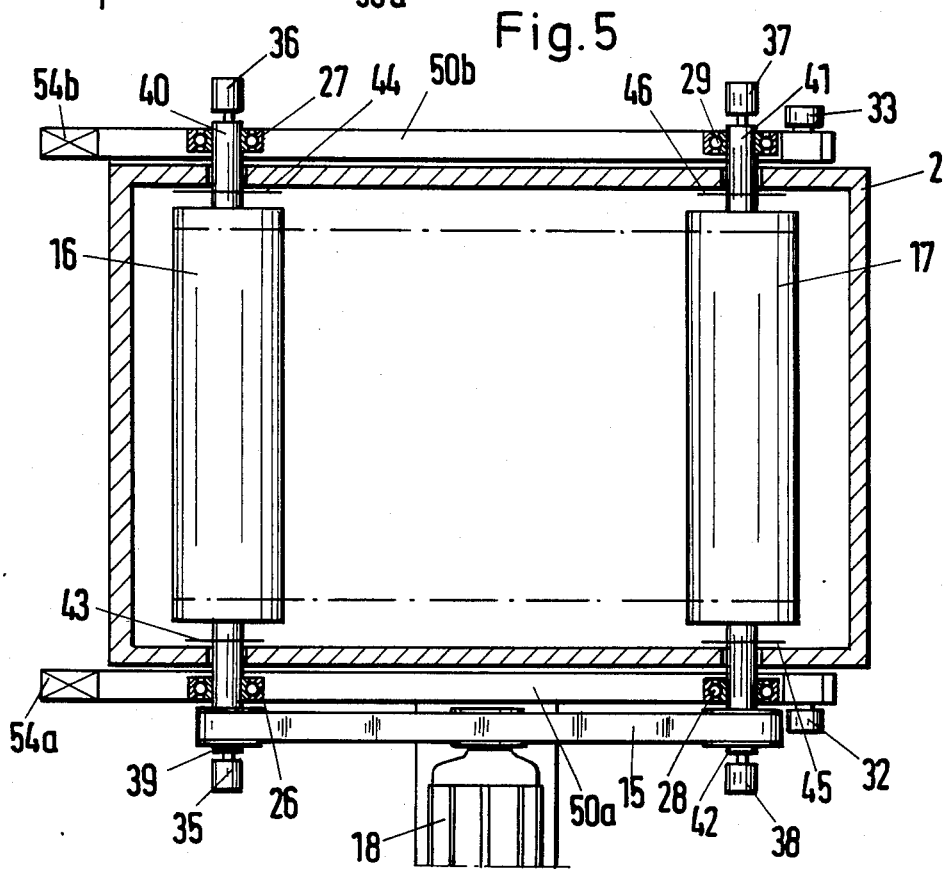
FIG. 5 a sectional view of the pair of guide rollers according to FIG. 4 along line II—II of FIG. 4.

The embodiment shown in FIGS. 4 and 5 differs from that of FIGS. 2 and 3 only by the construction of the rocker member. While in the embodiment shown in FIGS. 2 and 3 the rocker member is conceived as integral frame consisting of longerons **30*a* 30*b* and crossbeams 30*c*, 30*d*, the rocker member 50 of the embodiment shown in FIGS. 4 and 5 consists of two longerons 50*a*, 50*b*, the free ends of which located opposite their common rocker member axis 31 are each supported on pressure cells 54*a* or 54*b***. The measuring values emitted by the pressure cells are electrically added and fed to the web tension control device as actual value for the total longitudinal tension in the cloth web.

What is claimed is:

1. In a vertical drier for cloth webs having a web inlet and a web outlet both in a lower portion of the drier, driven conveyor means including a first guide roller in an upper portion of the drier for guiding the web upwardly from the inlet and a second guide roller in the upper portion of the drier for guiding the web downwardly to the outlet, and a web tension control device for controlling the speed of the conveying means in dependence on the longitudinal web tension including means for sensing the web tension in the downwardly guided cloth web, the improvement wherein the web tension control device further comprises means for separately measuring the web tension in the upwardly guided cloth web comprising rocker support means having a pivot axis, means mounting the second guide roller on the rocker support means adjacent the pivot axis and means mounting the first guide roller on the rocker support means spaced apart from the pivot axis and a sensings element responsive to the motion of the rocker support means for sensing the web tension of the upwardly guided web.

2. The web tension control device as defined in claim 1, wherein the pivot axis is aligned with the downwardly guided cloth web.

3. The web tension control device as defined in claim 2, wherein the second guide roller has a cylindrical surface and the pivot axis is aligned with the surface of the second guide roller.

4. The web tension control device as defined in claim 1, wherein the drier has lateral walls and the guide rollers have shafts with shaft ends extending through the lateral walls of the drier to the outside and wherein the rocker support means a frame enclosing drier housing and supporting the shaft ends.

5. The web tension control device as defined in claim 1, wherein the conveyor means comprises a motor for driving the guide rollers and wherein the motor is mounted on the rocker support means.

6. The web tension control device as defined in claim 5, wherein the drier has a housing and wherein the guide rollers comprise cooling rollers with shafts having ends extending from the drier housing and terminal heads for feed and discharge lines of a cooling agent.

7. The web tension control device as defined in claim 1, wherein the sensing element comprises a pressure gauge on which the rocker support means rests.

8. The web tension control device as defined in claim 1, wherein the sensing element comprises a tensionmeter from which the rocker support means is guided.

9. The web tension control device as defined in claim 1, wherein the rocker support means comprises a frame including longerons and crossbeams.

10. The web tension control device as defined in claim 1, wherein the rocker support means comprises two independent longerons and wherein one sensing element is connected to each longeron.

* * * * *